United States Patent [19]

Bianco

[11] 4,265,378

[45] May 5, 1981

[54] REVERSIBLE CLOSURE-SPOUT ASSEMBLY

[75] Inventor: Andrew S. Bianco, Lima, Ohio

[73] Assignee: Huffy Corporation, Miamisburg, Ohio

[21] Appl. No.: 8,119

[22] Filed: Jan. 31, 1979

[51] Int. Cl.[3] ..... B65D 47/06

[52] U.S. Cl. ..... 222/539; 22/542; 222/547

[58] Field of Search ..... 222/539, 542, 538, 547, 222/564

[56] References Cited

U.S. PATENT DOCUMENTS

| | | | |
|---|---|---|---|
| 301,575 | 7/1884 | Deverall | 222/539 X |
| 927,617 | 7/1909 | Weber | 222/542 X |
| 2,757,831 | 8/1956 | Schmidt | 222/542 X |

FOREIGN PATENT DOCUMENTS

| | | | |
|---|---|---|---|
| 226142 | 12/1959 | Australia | 222/539 |
| 129868 | 10/1932 | Austria | 222/539 |

*Primary Examiner*—Robert J. Spar
*Assistant Examiner*—Frederick R. Handren
*Attorney, Agent, or Firm*—Biebel, French & Nauman

[57] ABSTRACT

A reversible closure-spout assembly for a liquid container such as a gasoline can or the like is provided with a threaded closure cap having a central opening therein, an annular gasket in the cap, and a flexible pour spout having an outwardly projecting flange on one end. The flange has mounted on it a disc-shaped sealing member having a tapered upstanding central cylindrical portion, an inner annular portion having a plurality of slots, and a plurality of ribs extending inwardly toward the flange. In storage, the upstanding portion of the disc-shaped member forms a seal with the closure cap. In use, the direction of the spout assembly in the cap is reversed and liquid flows from the container through the slots in the disc-shaped member into the spout.

16 Claims, 6 Drawing Figures

REVERSIBLE CLOSURE-SPOUT ASSEMBLY

BACKGROUND OF THE INVENTION

The present invention relates in general to containers for gasoline or other inflammable volatile liquids and more particularly to reversible pouring spouts therefor.

Containers for gasoline and the like are often provided with a flexible spout to aid in pouring the contents of the container into an automobile fuel tank, a mower, etc. It is necessary that during storage these containers be reliably sealed so that their volatile contents will not spill out. It is also desirable that during periods of storage, the spout be kept out of the way and yet be readily accessible for the next pouring operation. However, in accomplishing these objectives, the container and spout structure must be inexpensive and simple to manufacture as well as durable.

There have been a wide variety of prior art reversible spout and container closures. For example, Martin, U.S. Pat. No. 3,958,729, shows a container with a reversible pouring spout threaded at both ends, having a closed end and an open end and having a side opening spaced from the closed end. Gersten, U.S. Pat. Nos. 3,185,361, 2,974,836, and 2,904,232, shows several variations of containers having reversible pouring spouts. The '361 patent requires the removal of a closure disk for each pouring operation and its reinsertion in the screw cap prior to closure. The '232 patent requires a container having two threaded screw caps and neck structure and the necessity of moving the pour spout from one threaded neck structure to the other for operation. The '836 patent shows a complicated double shell screw cap arrangement as does Dohrmann, U.S. Pat. No. 1,761,072. Lindsay, U.S. Pat. No. 1,374,932, shows a pour spout with a hollow plug therein which when screwed into place seals the contents of a container and when partially loosened permits liquid to flow out of the container from the spout.

SUMMARY OF THE INVENTION

In accordance with the present invention a reversible pour spout assembly for a gasoline container or the like is provided with a threaded closure cap having a central aperture therein, an annular gasket adapted to fit in the closure cap, a flexible pour spout having an outwardly projecting flange attached to one end thereof, and a disc-shaped sealing member mounted on the flange. The flange has an inner annular portion immediately adjacent the spout and an outer annular portion disposed outwardly from the inner annular portion and spaced slightly farther away from the end of the spout.

The sealing member mounted on the flange has a central upstanding section having a generally cylindrically shaped wall projecting away from the spout with a lid spanning the wall. The upstanding wall may be tapered slightly to provide a more secure sealing engagement with the central aperture in the closure cap when the spout assembly is in a storage configuration. The sealing member also has an inner annular portion and an outer edge section. The inner annular portion contains a plurality of slots extending about a circular arc concentric with the outer periphery of the member and, on the side facing the spout, has a plurality of inwardly projecting ribs which serve to maintain an open space between the inner annular portion of the sealing member and the inner annular portion of the flange. Additionally, both sides of the outer edge portion of the sealing member may have a plurality of annular projecting ridges which sealingly engage the annular gasket disposed in the closure cap.

The central apertures in the threaded closure cap and annular gasket are sized such that the flexible pour spout can be fitted through them when the spout is in a pouring configuration. The flange with sealing member thereon has a diameter only slightly smaller than the diameter of the threaded screw cap and fits tightly against the annular gasket within the cap during pouring. During pouring, liquid in the container passes through the plurality of slots in the sealing member and into the interior of the pour spout. A plurality of inwardly projecting ribs on the underside of the sealing member press against the inner annular portion of the flange and maintain the sealing member a small distance away from the flange during pouring to promote the flow of liquid through the slots and from the container. The pour spout optionally can have a filter element fitted over the end opposite the flange and disc to prevent the passage of large particles from the container during pouring.

When in a storage configuration, the direction through which the spout is fitted into the closure cap is reversed. The tapered, generally cylindrical upstanding portion on the sealing member is sized to fit through the central apertures in the annular gasket and closure cap in sealing engagement therewith.

As can be seen, it is an object of the present invention to provide a reversible pour spout for a container which is simple to use, inexpensive to manufacture, has no loose parts in the pour position, and reliable in operation. This and other objects and advantages of the invention will be apparent from the following description, the accompanying drawings, and the appended claims.

DESCRIPTION OF THE PREFERRED EMBODIMENTS

Figure 1:
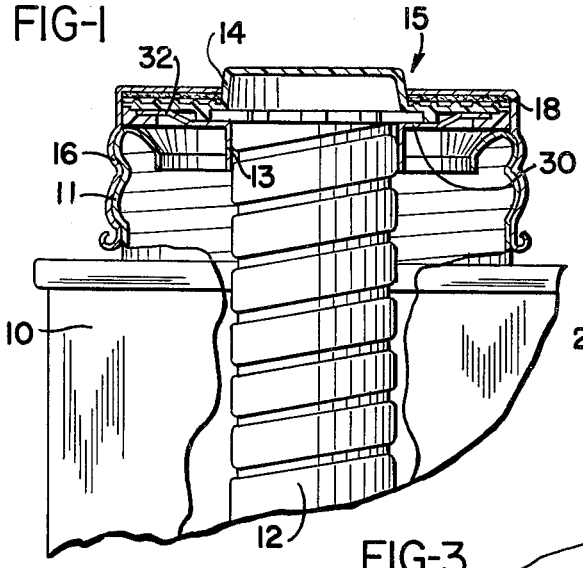
FIG. 1 is a side elevation, partially cut away, of the reversible pour spout of this invention in a storage configuration.
Figure 4:
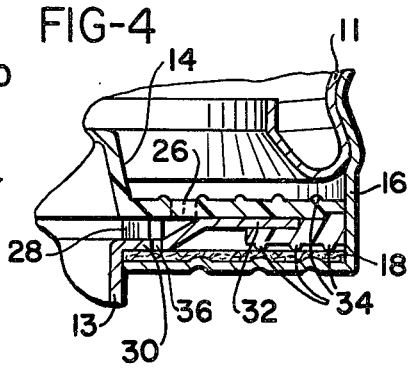
FIG. 4 is an enlarged cut away of a portion of the assembly shown in FIG. 3.

Referring first to FIG. 1, a liquid container 10 having a raised, threaded collar 11 thereon is provided with a reversible pour spout 12. Spout 12 is illustrated in FIG. 1 in a storage configuration with tapered upstanding portion 14 of sealing member 15 sealingly engaging circular holes in closure cap 16 and annular gasket 18. As illustrated in FIG. 4, the top portion of closure cap 16 may optionally be provided with a series of annular ridges to render the cap more rigid. The spout 12 has a flange 13 soldered or welded to one end thereof over which sealing member 15 is fitted. Flange 13 has an inner annular portion 30 immediately adjacent spout 12 and an outer annular portion 32 spaced from inner portion 30 and away from spout 12. A small aperture 36

(shown in FIG. 4) is provided in inner annular portion 30 which serves to equalize pressure between the container interior and the interior of spout 12 when the assembly is in the storage configuration. This aperture is sealed by gasket 18 when the assembly is in a pouring configuration.

Container 10 and collar 11 are preferably formed from sheet metal, with container 10 having sufficient strength to hold volatile liquids reliably and collar 11 having sufficient strength to provide a strong base into which the spout assembly may be threaded. The threads of the collar bore desirably are smoothly rounded to the same general configuration as the threads of the closure cap 16, thus reducing any tendency of the bore threads to damage the spout threads. Spout 12 may be of the hollow, spirally-wound, jointed metal type well-known in the art and is sized to fit easily inside collar 11. Optionally, spout 12 may have a wire-mesh filter (not shown) element attached to its pouring end.

In the storage configuration illustrated in FIG. 1, the sealing member 15 fitted over flange 13 on spout 12 is force fitted into closure cap 16. The diameter of sealing member 15 is only slightly less than the diameter of the inside of closure cap 16. Preferably, sealing member 15 is made of a flexible plastic or rubber material such as polyethylene or polypropylene which is resistant to degradation by gasoline or other volatile liquids which may be stored in the container. This flexibility will enable sealing member 15 to deform slightly around the threaded portion of cap 16 when it is force fitted therein. Additionally, the upstanding wall portion 14 of sealing member 15 is slightly tapered to provide better sealing engagement with the edges of annular gasket 18 and the central aperture in closure cap 16. Annular gasket 18 may be formed of a resilient, deformable material such as cork or rubber and is positioned at the top of closure cap 16. The diameter of gasket 18 is such that it will be held in place in cap 16 by the last turn of the inwardly projecting threads in the cap.

Figure 2:
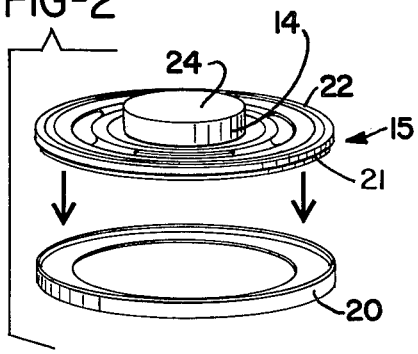
FIG. 2 is a perspective view of the annular disc shown in two pieces.

As illustrated in FIG. 2, sealing member 15 may initially comprise an upper slotted disc 22, with upstanding cylindrical wall portion 14 and lid 24, and lower annular disc 20. The rim of disc 20 is sized to fit snugly against a slot 21 around the circumference of upper disc 22. These two discs can then be placed on opposite sides of flange 13, brought together, and sealed. Sealing may be accomplished by ultrasonic welding or other suitable techniques known in the art. Alternatively, sealing member 15 may be molded as a single piece and fitted over flange 13 by deforming the lower edge portion of the member to slide over the edge of the flange.

Figure 3:
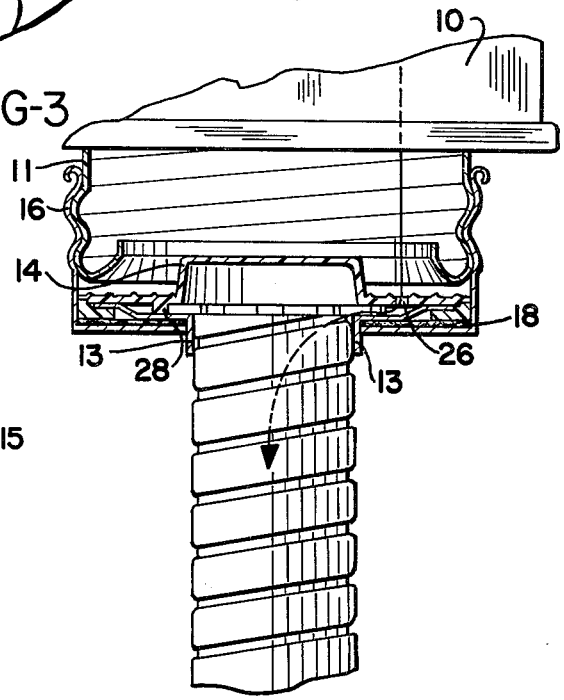
FIG. 3 is a side elevation, partially cut away, of the reversible pour spout of this invention in a pouring configuration.
Figure 5:
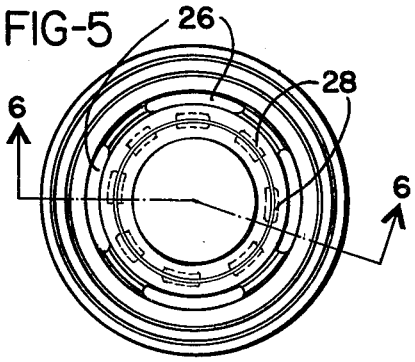
FIG. 5 is a top view of the annular disc.
Figure 6:
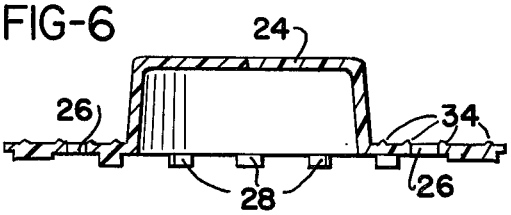
FIG. 6 is a sectional side view of the annular disc taken through line 6—6 in FIG. 5.

In use, the spout assembly is unscrewed from its storage configuration, slid out of closure cap 16, and reinserted in the opposite direction through the cap as shown in FIG. 3. In the pouring configuration illustrated in FIG. 3, the underside of sealing member 15 sealingly engages gasket 18 and the inside of closure cap 16 near its outer end. Sealing member 15 is provided with a plurality of annular projecting ridges 34 (not illustrated in FIGS. 1 and 3), which are best illustrated in FIGS. 4 and 6, to aid in forming a liquid-tight seal in closure cap 16. Liquid in the container passes through slots 26 which extend in a circular arc on sealing member 15 concentric with the periphery of the member. These slots 26 are best illustrated in FIGS. 4 and 5. Clearance from flange 13 is maintained by a plurality of ribs 28 extending inwardly toward the inner annular portion 30 of flange 13. These ribs are best illustrated in FIG. 6. In this manner, liquid passes through slots 26, around ribs 28 and into hollow spout 12 as shown by the arrow in FIG. 3.

The reversible spout assembly can be easily and quickly changed repeatedly from a storage to a pouring configuration. The flexible sealing member mounted on the flange of the spout insures both a good seal when in a storage configuration and a reliable liquid flow when in a pouring configuration. The member is simple and inexpensive to manufacture, permanently installed over the flange on the spout, and reliable in operation, eliminating the need for the complicated and expensive multi-piece spout assemblies of the prior art.

While the apparatus herein described constitutes preferred embodiments of the invention, it is to be understood that the invention is not limited to this precise apparatus, and that changes may be made without departing from the scope of the invention, which is defined in the appended claims.

What is claimed is:

1. A reversible closure-spout assembly including a tube having an outwardly projecting flange mounted thereon adjacent an inlet thereof, said flange including an inner annular portion immediately adjacent said tube and an outer annular portion disposed outwardly of said inner annular portion, a sealing member mounted on said flange, said sealing member including a central section, an inner annular section and an outer edge section surrounding said inner annular section, said central section including an axially extending annular wall projecting away from said tube and a lid spanning said annular wall, a plurality of ribs positioned between and spacing said inner annular portion of said flange from said inner annular section of said sealing member, and means defining openings through said inner annular section of said sealing member whereby liquid may flow through said openings in said inner annular section, around said ribs and between said inner annular portion of said flange and said inner annular section of said sealing member and into said inlet end of said tube.

2. The assembly of claim 1 where said annular wall of said central section of said sealing member is tapered in the direction away from said tube.

3. The assembly of claim 1 where said inner and outer sections of said sealing member are provided with a plurality of annular projecting ridges.

4. The assembly of claim 1 wherein said tube is made of a flexible metal conduit material.

5. The assembly of claim 1 wherein said sealing member is made of a flexible plastic material.

6. The assembly of claim 1 wherein said sealing member is made of polyethylene.

7. The assembly of claim 1 wherein said means defining openings in said inner annular section of said sealing member comprises a plurality of slots spaced about said inner annular section.

8. The assembly of claim 1 further comprising gasket means and a closure cap having central apertures therein, said gasket means being adapted to fit in said closure cap and said spout assembly being adapted to fit through said central apertures of said gasket means and said closure cap whereby said sealing member is in sealing engagement therewith.

9. The assembly of claim 1 wherein said inner annular portion of said flange lies in a plane displaced from a plane in which said outer annular portion lies.

10. The assembly of claim 1 wherein said outer edge section of said sealing member extends around an outer edge of said outer annular portion of said flange.

11. A reversible closure-spout assembly including a tube having an outwardly projecting flange mounted thereon adjacent an inlet thereof, said flange including an inner annular portion immediately adjacent said tube and an outer annular portion disposed outwardly of said inner annular portion, a sealing member mounted on said flange, said sealing member including a central section, an inner annular section and an outer edge section surrounding said inner annular section, a plurality of annular projecting ridges on said inner annular section and said outer edge section, said central section including an axially extending annular wall projecting away from said tube and tapered in a direction away from said tube and a lid spanning said annular wall, said inner annular portion of said flange and said inner annular section of said sealing member being disposed in spaced relationship to each other by a plurality of ribs on said inner annular section extending inwardly toward said inner annular portion of said flange, and means defining openings through said inner annular section of said sealing member whereby liquid may flow through said openings, around said ribs, between said inner annular portion of said flange and said inner annular section of said sealing member and into said inlet end of said tube.

12. The assembly of claim 11 where said tube is made of a flexible metal conduit material.

13. The assembly of claim 12 where said sealing member is made of a flexible plastic material.

14. The assembly of claim 13 where said sealing member is made of polyethylene.

15. The assembly of claim 14 where said means defining openings in the inner annular section of said sealing member comprise a plurality of slots spaced about said inner annular section.

16. The assembly of claim 15 further comprising a gasket means and a closure cap having central apertures therein, said gasket means being adapted to fit in said closure cap and said spout assembly being adapted to fit through said central apertures of said gasket means and said closure cap whereby said sealing member is in sealing engagement therewith.

* * * * *